US007066359B2

(12) United States Patent
Greiner-Perth

(10) Patent No.: US 7,066,359 B2
(45) Date of Patent: Jun. 27, 2006

(54) DISPENSER FOR THE DISCHARGE OF FLOWABLE MEDIA

(75) Inventor: Juergen Greiner-Perth, Gottmadingen (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 410 days.

(21) Appl. No.: 10/428,616

(22) Filed: May 2, 2003

(65) Prior Publication Data

US 2004/0000567 A1 Jan. 1, 2004

(30) Foreign Application Priority Data

May 2, 2002 (DE) ..... 102 20 557

(51) Int. Cl.
*B65D 88/54* (2006.01)

(52) U.S. Cl. ..... 222/321.2; 222/321.9; 222/385

(58) Field of Classification Search ..... 222/321.1, 222/321.2, 321.6, 321.7, 321.9, 382, 383.1, 222/385, 464.1
See application file for complete search history.

(56) References Cited

U.S. PATENT DOCUMENTS

| | | | | |
|---|---|---|---|---|
| 5,358,149 | A * | 10/1994 | O'Neill | 222/321.2 |
| 5,785,208 | A * | 7/1998 | Dobbs et al. | 222/148 |
| 5,803,318 | A * | 9/1998 | Lina | 222/321.2 |
| 6,056,163 | A * | 5/2000 | Lai | 222/321.2 |
| 6,145,710 | A | 11/2000 | Carter | |
| 2002/0008122 | A1 | 1/2002 | Ritsche et al. | |

FOREIGN PATENT DOCUMENTS

EP 0 853 500 B1 4/2000

* cited by examiner

*Primary Examiner*—Michael Mar
*Assistant Examiner*—Patrick Buechner
(74) *Attorney, Agent, or Firm*—D. Peter Hochberg; Sean Mellino; Katherine R. Vieyra

(57) ABSTRACT

A dispenser for flowable media is provided, which operates in user-independent manner with respect to the pressure buildup and dosage quantity. On pressing on an operating head (35) a piston rod (29) is forced into a pump cylinder. As the pump chamber (52) is sealed by means of a delivery valve (51), which operates in path-dependent manner as a slide valve, under the action of a spring (42) pressing on the piston collar (43), a pressure builds up in the pump chamber (52), which is released following a predetermined length of travel on opening the delivery valve. A relatively constant pressure can be obtained over the entire discharge phase through the pretension of spring (42).

12 Claims, 2 Drawing Sheets

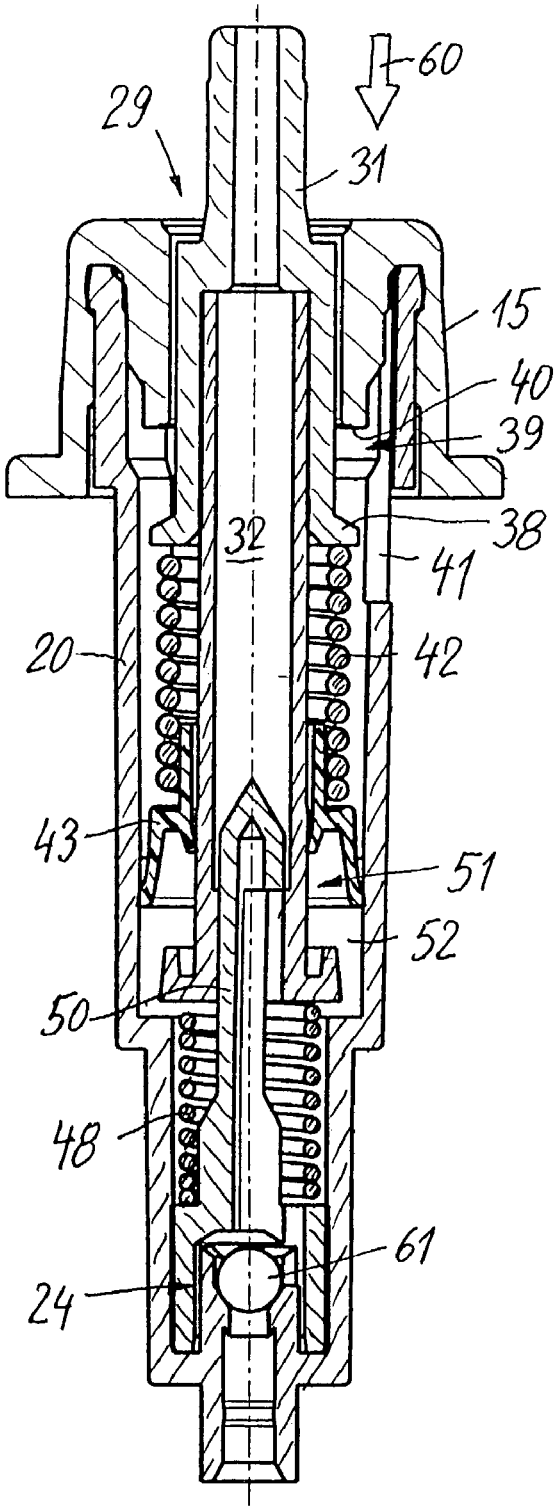
Fig. 2
Fig. 3
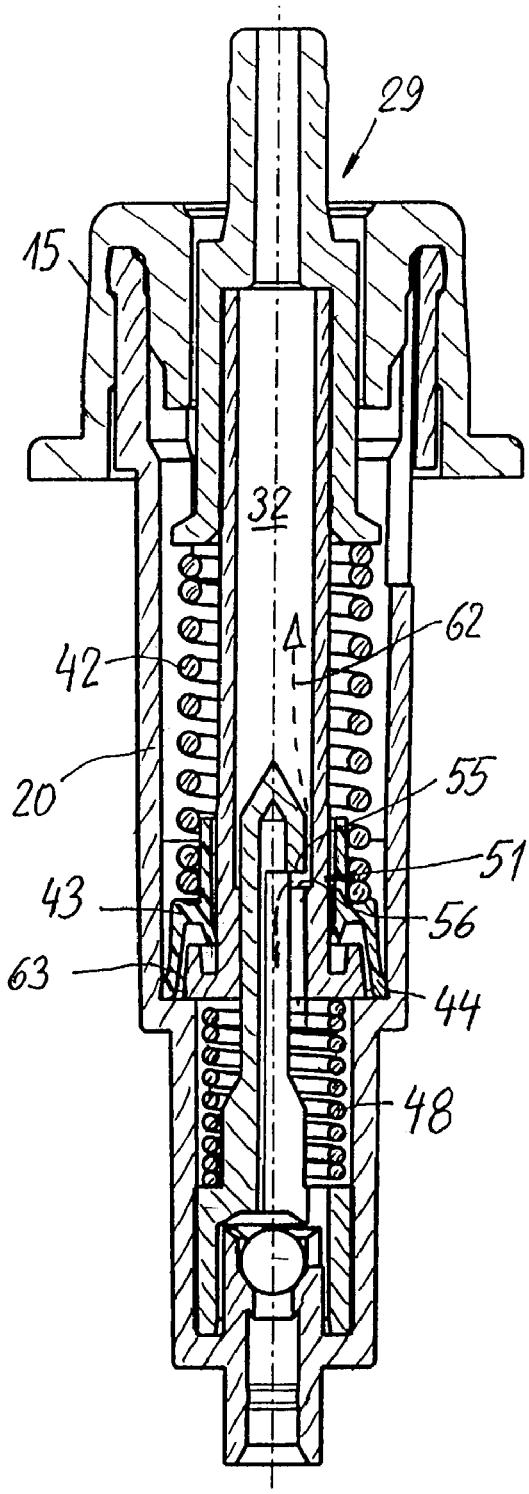

DISPENSER FOR THE DISCHARGE OF FLOWABLE MEDIA

BACKGROUND OF THE INVENTION

The invention relates to a dispenser for discharging flowable media with a preferably manually operated pump. Such pumps are intended for liquids, pastes, foams, etc. and are used for their dosing, spraying or other discharging processes. The pumps used are usually thrust piston pumps, which are operated by means of a hollow piston rod and a pushbutton or trigger mounted thereon and which simultaneously carries the discharge opening, e.g. a spraying nozzle.

When operating such dispensers it is always a problem to make the discharge process independent of the individual operation by the user in order to e.g. produce a uniform dosing and in particular, in the case of spraying devices, a uniform spray pattern.

Therefore dispensers have been developed which operate in such a way that when operated by the user they firstly tension a spring, followed by a spring-operated discharge process. Mention is e.g. made in this connection of U.S. Pat. No. 6,145,710 A, which on depressing the discharge nipple a piston connected thereto in a larger diameter cylinder displaces counter to a spring tension a piston running in a smaller diameter cylinder connected thereto. After opening the delivery valve by releasing a fixed head, the liquid can be discharged under the tension of a spring acting on the smaller piston.

OBJECT OF THE INVENTION

Object of the invention is to provide a dispenser, whose discharge process is largely independent of the nature of the operation by the user and which has a relatively simple and compact construction. There is in particular to be a discharge with a very constant pressure.

SUMMARY OF THE INVENTION

According to the invention the pump, which has a pump cylinder, is provided with a piston having a piston rod operable in one operating direction and a delivery piston element, which can e.g. be constructed as an annular piston collar. A pump inlet is provided with an intake valve, which can e.g. be constructed as a weight-loaded or spring-loaded ball valve. The pump outlet has a delivery channel, which in most cases is led through the piston rod, which in turn permits the mounting of a pushbutton or trigger combined with a spraying nozzle.

The delivery piston element is axially displaceably and sealingly guided on the piston rod, being loaded by a spring element, which brings about the media discharge, in that it is supported on the piston rod and is tensioned by the movement of the piston rod in the operating direction. Following the opening of the delivery valve, it gives rise to media discharge, in that it runs in the operating direction under the tension of the spring element.

It is particularly simple and appropriate if the delivery piston element is an annular piston collar, which is sealingly guided on the piston rod and in the pump cylinder. However, it would also be possible to construct the delivery piston element as a piston running in the hollow piston rod and then the spring would also have to be located there.

The piston can be loaded counter to the operating direction by a return spring element, so that the pump, in the manner of a single-acting pump, following the release of an operating element such as a pushbutton, returns again to the starting position.

In the case of the dispenser according to the invention it is particularly advantageous that the springs and in particular the spring element provided for discharge purposes, can be relatively strongly pretensioned. As a result the spring tension is relatively constant over the entire feed stroke, because use is only made of a small section of the spring characteristic. Despite this the spring does not have to be excessively long. As the piston collar runs counter to the operating direction for its feed energy-storing movement or remains in a virtually axially invariable state, the entire dispenser can be made relatively short. It is merely necessary to provide the tension path for the discharge spring element and the relatively short delivery stroke of the main delivery piston, i.e. the piston collar in the present embodiment.

The dispenser is tensioned in that the piston rod is forced into the cylinder. It tensions the discharge delivery element and also moves some liquid into the pump chamber, which is compensated in that the delivery piston element under further pretensioning of the discharge delivery element is forced axially counter to the operating direction.

At the end of this tension stroke the discharge operation is initiated in that the previously tightly closed pump chamber is released in the direction of the delivery channel by means of the delivery valve.

This preferably takes place by means of a path-controlled valve, which can be constructed in the manner of a slide valve. It can be provided on a ram, which in the form of a laterally slit hollow needle engages in the interior of the piston rod and together with the latter firstly seals the pump chamber against the delivery channel and then, on freeing the same by two cooperating control edges, brings about the discharge of the pressurized content of the pump chamber into the delivery channel. The pump chamber empties under the relatively uniform pressure exerted by the discharge spring on the delivery piston element. After freeing the piston rod the return spring moves the piston rod/delivery piston element unit, including the pretensioned discharge spring, back into the starting position and sucks up liquid via the intake valve.

No problems arise when priming the pump chamber which is not yet filled with liquid, because the delivery valve is path-controlled and consequently there is no "dead" air compression in the pump chamber.

The necessary ventilation of the container is also possible by means of a ventilation valve, which has a sealing face on a shoulder of the two-part piston rod, which cooperates with a casing part and forms the ventilation path via a slot in the pump chamber. The ventilation valve is only open during the short operating process and consequently the container is tightly sealed by means of the pump in the rest state.

Thus, a dispenser for flowable media is provided, which operates in user-independent manner with respect to the pressure buildup and the dosage quantity.

In the context of the present invention, the user can be a person and also a mechanically or otherwise driven device, which brings about the pump operating process. Thus, the dispenser can e.g. serve as a predoser for inhalers or other medical implements, which further process the delivered charge.

When pressure is exerted on an operating head, a piston rod is pressed into a pump cylinder. As the pump chamber is closed by means of a delivery valve operating in path-dependent manner as a slide valve, under the action of a spring pressing on the piston collar, a pressure builds up in the pump chamber, which is released on opening the delivery valve following a predetermined length of travel. Through the pretensioning of the spring a relatively constant pressure can be obtained over the entire discharge phase.

The above and further features can be gathered from the claims, description and drawings and the individual features, both singly or in the form of subcombinations, can be implemented in an embodiment of the invention and also in other fields and can represent advantageous, independently protectable constructions for which protection is claimed here. The subdivision of the application into individual sections and the subheadings in no way restrict the general validity of the statements made thereunder.

In the case of manual operation a lever transmission on the pump drive is also possible, e.g. a construction with lateral operating lever such as is described in DE 100 32 976 A, to which reference should be made for further details.

BRIEF DESCRIPTION OF THE DRAWINGS

An embodiment of the invention is described in greater detail hereinafter relative to the attached drawings, wherein show:

FIGS. 1 to 3 Three different operating phases of a dispenser according to the invention shown in longitudinal section, FIG. 1 showing a dispenser including the pushbutton/spraying nozzle combination of the container and FIGS. 2 and 3 only show the pump.

DETAILED DESCRIPTION OF THE EMBODIMENT

Figure 1:
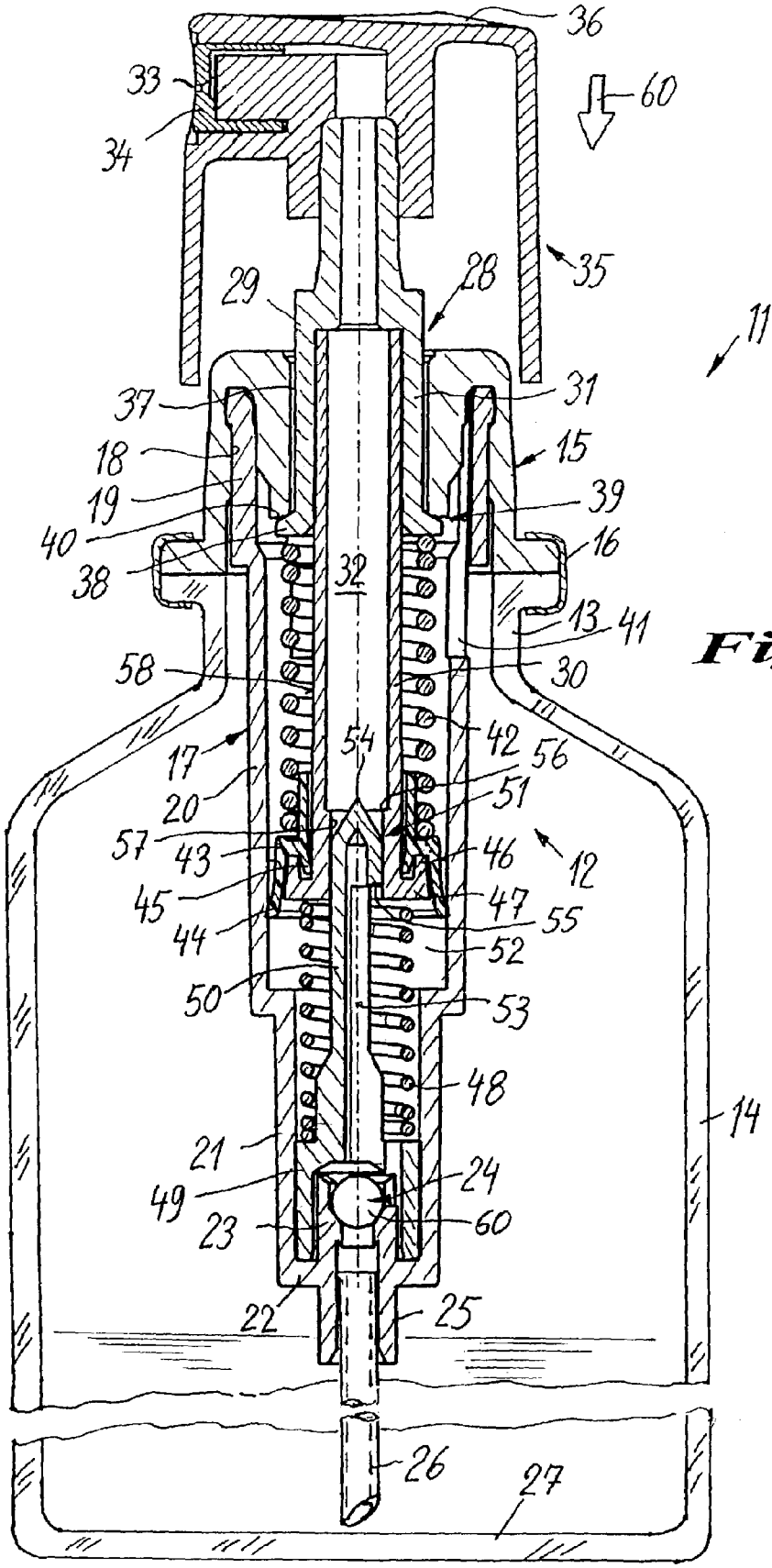

FIG. 1 shows a dispenser 11 with a pump 12, which is mounted on the neck 13 of a container 14 constructed like a glass bottle and projects into the same with the greatest part of its longitudinal extension. The pump has a base casing, which is fixed on the bottle neck 13 by means of a crimp seal 16.

Into the base casing 15 is snapped an elongated cylinder body 17, namely in an axial annular groove 18 between an outer part and an inner part of the base casing. Below its snapping-in portion, the cylinder body forms a pump cylinder 20 and following on to the same a diameter-reduced, also cylindrical cylinder portion 21. The latter terminates in a base 22 on which is inwardly constructed part of a cage 23 for a ball intake valve 24 and connected thereto a connection 25 extends outwards and into it is inserted a suction tube 26, which extends to the container bottom 27.

Into the cylinder 20 projects a piston 28, which has a tubular piston rod 29, which is assembled from two firmly telescoped hollow bodies 30, 31. In its interior, the piston rod 29 forms a delivery channel 32, which is connected to a pump outlet 33 in the form of a spraying nozzle 34. The latter is provided in an operating head 35, which simultaneously forms a trigger or pushbutton with a finger pressure surface 36 for manual dispenser operation. The operating head 35 is pressed onto the upper connection of the piston rod, i.e. the hollow body 31 and its outer jacket runs outside the base casing 15.

On the end directed towards the pump cylinder on the upper hollow body section 31 of the piston rod 29, which projects through the central opening of the base casing 15 accompanied by the formation of an air gap 37, is shaped a flange-like, bevelled shoulder 38, which forms a sealing surface for a ventilation valve 39, namely in conjunction with the inner end face 40 of the base casing 15 pointing towards the pump cylinder. An opening 41 is provided in the pump cylinder wall for the operation of the ventilation valve.

On the shoulder 38 is supported a discharge spring element 42 in the form of a pretensioned helical spring, which with its other side presses on a piston collar 43 forming the delivery piston element. The piston collar 43 runs with an outer sealing lip 44 on the inner cylinder surface of the pump cylinder 20 and with an inner sealing lip 45 on the outer circumference of the tubular hollow body part of the piston rod 29. A piston collar section projecting up therefrom in the direction of the helical spring and within the same guides the said helical spring and the collar on the piston rod.

Between the two sealing lips 44, 45 is formed a groove, in which engages a stop projection 46 of a diameter-enlarged end section 47 of the piston rod 29. On the latter is supported a return spring 48, which is also constructed as a helical spring and is guided in the narrower cylinder section 21. The return spring 48 is supported on the base section 49 of a ram 50, whose inner recess forms the upper part of the cage 39 for the ball intake valve and engages with a pin or needle-like part in the interior of the hollow piston rod 29. Together with the piston rod it forms the delivery valve 51 for the pump chamber 52.

For this purpose the ram 50 is provided with a channel in the form of an elongated slot 53, which ends at a certain distance from the upper, pointed tip 54 of the ram. It consequently forms a control edge 55 for the delivery valve.

On the piston rod 29 is provided the corresponding counter-control edge 56 at the inner end of a precisely calibrated bore 57, whose diameter is reduced compared with the remainder of the delivery channel 32. The section located on the ram between the tip 54 and the control edge 55 engages in precisely fitting, sealing manner in the bore 57.

Apart from the helical springs and balls 24, the dispenser 11 can be entirely manufactured from plastic mouldings. The pump comprises two casing parts 15, 17, the piston 28 with the two-part piston rod 29 and the piston collar 43 and ram 50. All the parts can be fitted in simple manner by merely assembling or pressing together. Optionally it is also possible to replace the metal parts by correspondingly shaped plastic parts, e.g. plastic bellows or cushion springs.

FUNCTION

FIG. 1 shows the dispenser 11 in the rest or inoperative position. The piston 28 has moved upwards under the action of the return spring 48, so that a sealing surface for the ventilation valve-forming shoulder 38 engages on the corresponding counter-sealing surface 40 of the base casing 15 and seals the container against outside air.

The delivery valve 51 is also closed, because the ram 50 is engaged in the bore 57 and the control surface 55 has not reached the control surface 56. The helical spring 42 forming the discharge spring element is admittedly pretensioned, but in its maximum operating extension. It presses the piston collar 43 against the end section 47 of the piston rod 29. The sealing lips 44, 45 engage on the pump cylinder wall 20 and the cylindrical outer wall 58 of the piston rod 29 in sealing manner. The tension of the spring is absorbed by the annular stop projection 46 on end section 47, which engages between the two sealing lips, which are consequently relieved of the compressive force exerted by the spring.

It is assumed that the pump chamber 52 has already been filled with medium 59 from container 14.

If now and as is shown in FIG. 2, by means of the operating head 35 the piston rod 29 is pressed into the pump, a pressure builds up in the pump chamber 52. This is on the one hand due to the fact that by means of the shoulder 38 and spring 42 an axial pressure is exerted on the piston collar 43 and on the other the lower section of the piston rod moves into the pump chamber and consequently displaces volume. As the delivery valve 51 is still closed up to the position shown in FIG. 2, the displacement of this liquid volume part means that the piston collar is forced axially upwards counter to the operating direction 60 and under further tension of spring 42. As a result of the spring tension applied in the operating direction 60, the return spring 48 is also compressed. The pressure formed in the pump chamber 52 presses the balls 61 of the intake valve 24 on their valve seat and keeps the same closed.

However, the ventilation valve 39 is opened, in that the shoulder 38 forming one sealing surface has lifted from the end face 40 and by means of the gap 37 and the opening 41 in the pump cylinder a connection is provided between the outside air and the container 14.

In this position admittedly no medium has flowed through the delivery channel 32, but now the dispenser is tensioned for performing an automatic discharge process.

In the manner shown in FIG. 3, this is initiated in that the control edges 55, 56 of delivery valve 51 pass one another and consequently, as indicated by the broken line arrow 62, medium can flow from the pump chamber 52, via delivery valve 51 into outlet channel 32 under the pressure produced by spring 42, via piston collar 43. As a result of the pretensioning possibility of helical spring 42 said pressure is very uniform and can be adjusted precisely to the optimum atomization conditions at nozzle 34. The medium flows through the outlet channel 32 to nozzle 33 and there is rotated by whirl channels and atomized in the form of a conical spray cone.

FIG. 3 shows the final position for the discharge process in which the outer sealing lip 44 is pushed onto the step 63 formed between cylinder parts 20, 21. For the user, who has started the operating process by finger pressure on the pressure surface 36, there is consequently a pressure point-like operating sequence. He presses the operating head 35 and therefore the piston rod into the pump, without anything happening at the start. At a position predetermined by the mutual positioning of the two control edges 55, 56 and usually close to the end position of FIG. 3, the spraying process commences without any further action on his part.

Thus, the spraying process not only takes place with a very constant and precisely predeterminable pressure, but also the dosing quantity satisfies high precision demands. It can also be predetermined by the position of the control edges and consequently during production by a simple processing of mouldings for different requirements. Thus, e.g. different rams 50 can be produced and therefore different dosing quantities can be obtained with otherwise unchanged pump construction.

After relieving the operating head 35 the return spring 48 presses back into the position according to FIG. 1 the entire piston, i.e. the two-part piston rod 29, piston collar 43 and spring 42 (without again compressing them beyond their predetermined pretension). The volume of the pump chamber 52 increases again, so that by means of the ball intake valve 24 opened by the negative pressure and the suction tube 26 medium 59 can be sucked into the pump chamber 52. As can be seen in FIG. 1, the delivery valve is then again closed.

Priming takes place easily by means of a single or a few operating strokes. In the case of a not liquid-filled pump chamber, no significant pressure is produced therein and consequently the piston collar 43, also on pressing down in operating direction 60 (FIG. 2), relative to the piston rod remains in its position according to FIG. 1. On reaching the position according to FIG. 3, the delivery valve 51 is opened and the slightly compressed air in pump chamber 52 is forced out by means of the delivery channel 32. Depending on the size of the pump dead space formed in the cylinder section 51, the entire pump chamber can be filled with liquid with a few strokes.

What is claimed is:

1. A dispenser for discharge of flowable media comprising:

a pump having a pump cylinder, said pump cylinder having a pump inlet with an intake valve;

a piston with a piston rod being operable in an operating direction, said piston having:

a delivery piston element having a spring element to form a spring loaded delivery piston element; and a pump outlet including a delivery valve, said delivery valve being a path-control valve, and an outlet channel, said spring element being loaded in response to movement of the piston rod in the operating direction, said media being discharged in response to the opening of the delivery valve, the discharge being effected by the action of the spring loaded delivery piston element; whereby the discharge of said media being effected after said path controlled opening of the delivery valve without the need of moving the piston rod further in the operating direction.

2. A dispenser according to claim 1, wherein the delivery piston element is an annular piston collar, which is sealingly guided on the piston rod and in the pump cylinder.

3. A dispenser according to claim 2, wherein the piston rod is constructed from two telescoped hollow bodies, one hollow body having an outer circumference forming a path for the delivery piston element and the other hollow body containing a support for the spring element.

4. A dispenser according to claim 1 and further including a return spring element for loading the piston counter to the operating direction.

5. A dispenser according to claim 4, wherein at least one of said spring element and said return spring element is pretensioned.

6. A dispenser according to claim 1, wherein the piston rod comprises a displacement piston guided in the delivery piston element.

7. A dispenser according to claim 1, wherein the piston rod has a ventilation valve for a medium-containing container, the ventilation valve having a sealing surface for cooperating with an opening in a casing surface of the pump cylinder for providing a connection for the outside air, via the ventilation valve, to the container.

8. A dispenser according to claim 1, wherein the outlet channel passes through the piston rod.

9. A dispenser according to claim 1, wherein the piston rod has an end section located in the operating direction with a stop step, said stop step having a stop projection engaging behind a sealing lip of the delivery piston element.

10. A dispenser for discharge of flowable media comprising:

a pump having a pump cylinder, said pump cylinder having a pump inlet with an intake valve;

a piston with a hollow piston rod being operable in an operating direction, said piston having:

a delivery piston element having a spring element to form a spring loaded delivery piston element; and a pump outlet including a delivery valve, the delivery valve being a path-control valve, the delivery valve having a ram-shaped valve body engaging the hollow piston rod, said delivery valve being provided with a valve channel and a valve control edge, said hollow piston rod forming an associated counter-control edge, and an outlet channel;

said spring element being loaded in response to movement of the piston rod in the operating direction, said media being discharged in response to the opening of the delivery valve, the discharge being effected by the action of the spring loaded delivery piston element; whereby the discharge of said media being effected after said path controlled opening of the delivery valve without the need of moving the piston rod further in the operating direction.

11. A dispenser for discharge of flowable media comprising:

a pump having a pump cylinder, said pump cylinder having a pump inlet with an intake valve;

a piston with a piston rod being operable in an operating direction, said piston having:

a delivery piston element having a spring element to form a spring loaded delivery piston element; and a pump outlet including a delivery valve, said delivery valve being a path-control valve having a valve body, and an outlet channel;

said spring element being loaded in response to movement of the piston rod in the operating direction, said media being discharged in response to the opening of the delivery valve, the discharge being effected by the action of the spring loaded delivery piston element; whereby the discharge of said media being effected after said path controlled opening of the delivery valve without the need of moving the piston rod further in the operating direction;

said dispenser further including:

a casing portion;

a return spring and a cage;

the casing portion receiving the valve body, the diameter of said casing portion being smaller than the diameter of the pump cylinder, the return spring surrounding the valve body, and further having a cage containing the intake valve and having a base section, the base section being surrounded by the return spring.

12. A dispenser for discharge of flowable media comprising:

a pump having a pump cylinder, said pump cylinder having an intake valve;

a piston with a piston rod being operable in an operating direction, said piston having:

a delivery piston element having a spring element to form a spring loaded delivery piston element; and a pump outlet including a delivery valve, said delivery valve being a path-control valve, and an outlet channel, said spring element being loaded in response to movement of the piston rod in the operating direction, said media being discharged in response to the opening of the delivery valve, the discharge being effected by the action of the spring loaded delivery piston element, whereby the discharge of said media being effected after said path controlled opening of the delivery valve without the need of moving the piston rod further in the operating direction;

wherein the delivery piston element is an annular piston collar sealingly guided on the piston rod and in the pump cylinder, said dispenser further including a return spring element for loading the piston counter to the operating direction; and the piston rod has a ventilation valve for a medium-containing container, said ventilation valve having a sealing surface for cooperating with an opening of a casing surface of the pump cylinder for providing a connection for the outside air, via the ventilation valve, to the container.

* * * * *